US006390715B1

(12) United States Patent
Gerbasi

(10) Patent No.: US 6,390,715 B1
(45) Date of Patent: May 21, 2002

(54) INFORMATION DISPLAYING AND DISPENSING APPARATUS WITH TRANSPARENT POCKETS

(76) Inventor: Kathleen C. Gerbasi, 601 Sherwood Ct., Lewiston, NY (US) 14092

( * ) Notice: Subject to any disclaimer, the term of this patent is extended or adjusted under 35 U.S.C. 154(b) by 0 days.

(21) Appl. No.: 09/871,311

(22) Filed: May 31, 2001

Related U.S. Application Data

(60) Provisional application No. 60/211,006, filed on Jun. 12, 2000.

(51) Int. Cl.[7] ..... B42F 13/00

(52) U.S. Cl. ..... 402/79; 283/116; 283/56; 229/68.1

(58) Field of Search ..... 402/4, 79, 80 R, 402/502; 281/38, 51; 283/116, 56, 117, 107; 462/64, 65; 229/68.1, 72; 40/124.1

(56) References Cited

U.S. PATENT DOCUMENTS 3,198,228 A 8/1965 Naito
3,473,589 A 10/1969 Gotz
3,827,472 A 8/1974 Uramoto
4,676,526 A * 6/1987 Redman ..... 283/81
4,846,585 A 7/1989 Boeckmann et al.
4,958,450 A 9/1990 Roberg
5,125,561 A * 6/1992 Idstein ..... 283/116 X
5,487,566 A * 1/1996 Hedge, Jr. ..... 283/116 X
5,648,143 A * 7/1997 Mehta et al. ..... 229/71
5,722,694 A 3/1998 Baldursson
6,019,539 A 2/2000 Lynton
6,023,790 A 2/2000 Schwartz
6,299,530 B1 * 10/2001 Hansted et al. ..... 283/116 X

* cited by examiner

*Primary Examiner*—Willmon Fridie, Jr.
(74) *Attorney, Agent, or Firm*—Greenwald & Basch LLP; Duane C. Basch

(57) ABSTRACT

The present invention is an apparatus and method for the display and mailing of advertisements including a large transparent display window and a plurality of transparent pockets associated therewith for the purpose of providing cards or samples, and to such an apparatus that may be easily folded and sealed so as to provide its own mailing envelope and also having a plurality of holes along one edge so as to be suitable for storage in a binder notebook.

20 Claims, 3 Drawing Sheets

INFORMATION DISPLAYING AND DISPENSING APPARATUS WITH TRANSPARENT POCKETS

This application claims benefit to provisional application 60/211,006 filed Jun. 12, 2000.

This invention relates generally to the display of documents, and more particularly to an apparatus including a large transparent display window and a plurality of transparent pockets associated therewith for the purpose of providing cards or samples to viewers, and to such an apparatus that may be further employed to provide a mailing envelope or holes for storage in a binder or notebook.

BACKGROUND AND SUMMARY OF THE INVENTION

A well-known method for advertising items for sale or displaying information to passers-by is to place a paper or document having information printed thereon (referred to as a "bill") onto the surface of a wall, bulletin board, or message board. Furthermore, it is common practice to provide tear-able strips along the bottom or an edge of the "bill" in order to allow an interested person to retrieve further information such as a telephone number, address, meeting time, etc. Alternatively, people may include cards or small slips of paper in an envelope stapled or glued to the "bill."

The present invention is directed at an improved apparatus for distributing, displaying, mailing and storing such information. In particular, an apparatus in one embodiment of the present invention includes a first resealable, transparent pocket for holding the advertising copy or "bill" and one or more smaller, transparent pockets that may be suspended therefrom to hold smaller pieces of paper or similar printable substrate (e.g., business cards) for an interested party to retrieve.

Heretofore, U.S. Pat. No. 5,722,694 to Baldursson, issued Mar. 3, 1998, has disclosed an envelope that includes a transparent sleeve for holding an overhead projector transparency.

In accordance with the present invention, there is provided an envelope for holding a primary sheet having information displayed thereon in selective juxtaposition with a plurality of secondary sheets, comprising: a sleeve for removably holding the primary sheet and having at least one transparent surface and at least one open edge for receiving the primary sheet therein so that at least a portion of the primary sheet is visible through the transparent surface; and at least two pockets, attached to said transparent sleeve along a first edge thereof, for removably holding the plurality of secondary sheets therein, the pockets being hingedly connected to the transparent sleeve along an edge thereof for movement between a juxtaposed position, wherein the pockets are flush with the sleeve and overlay the secondary sheets on the primary sheet, and a distanced position, wherein the pockets are not flush and the secondary sheets and are not overlaid on the primary sheet, wherein the pockets cover less than one-half of the surface area of the transparent rectangular sleeve while in the juxtaposed position.

In accordance with another aspect of the present invention, there is provided a mailing device, comprising: a substantially rectangular panel of opaque material, one face of the opaque material having a space for a recipient address; an envelope, formed by at least one transparent rectangular sheet affixed to the opposing face of the opaque material, for removably holding a primary sheet having information displayed thereon in selective juxtaposition with a plurality of secondary sheets and having at least one open edge for receiving the primary sheet therethrough; and a plurality of rectangular pockets, attached to said envelope along an edge thereof, for removably holding the plurality of secondary sheets therein, the at least two pockets being hingedly connected to the envelope along an edge thereof for movement between a juxtaposed position, wherein the pockets are flush within the sleeve and overlay the secondary sheets on the primary sheet, and a distanced position, wherein the pockets are not flush and the secondary sheets are not overlaid on the primary sheet.

In accordance with yet a further aspect of the present invention, there is provided a method for shipping and displaying a primary sheet and a plurality of secondary sheets associated with the primary sheet, including the steps of: inserting the primary sheet, the sheet having information displayed thereon, in an envelope, a portion of which is transparent so as to allow the information on the primary sheet to be viewed through the envelope, wherein the primary sheet is inserted through an open edge of the envelope for receiving the primary sheet therein; inserting into one of a plurality of pockets attached to said transparent envelope along a first edge thereof, a plurality of secondary sheets; folding, at a position parallel to the first edge, the plurality of pockets attached to said transparent envelope into the interior of the transparent envelope to hold the primary sheet in selective juxtaposition therewith; sealing a seal along said first edge to retain the pockets and secondary sheets therein in juxtaposition with the primary sheet; shipping the sealed envelope; opening the envelope upon receipt by breaking the seal along the first edge so as to allow removal of the pockets and secondary sheets therein; removing the pockets and secondary sheets therein; and unfolding the plurality of pockets attached to said transparent envelope so as to reveal the primary sheet retained in the transparent envelop and the secondary sheets retained in the pockets..

One aspect of the invention is based on the discovery that bills or other advertisements posted in areas exposed to the inclement weather (e.g., rain, snow) often are destroyed before the event date is reached or before the information on the bill is no longer of value. This discovery avoids problems that arise with the typical method of posting such bills, and further provides convenient, weather-resistant pockets for the temporary storage (and easy retrieval) of business cards or other information for interested parties.

The apparatus described herein is advantageous because it is a simple and inexpensive apparatus that will withstand the elements to which most advertising bills are exposed. The apparatus makes it unnecessary to have tear-away tabs or to attach pockets to bills before posting, providing refillable pockets for information cards, sheets or samples. The apparatus is also reusable with a different bill and/or cards, sheets or samples. Moreover, the apparatus is flexible in that it can also be adapted for use as a mailer for distribution of the bills to be posted. The techniques of the invention are advantageous because they provide a range of alternative configurations, each of which is useful in appropriate situations.

Figure 1:
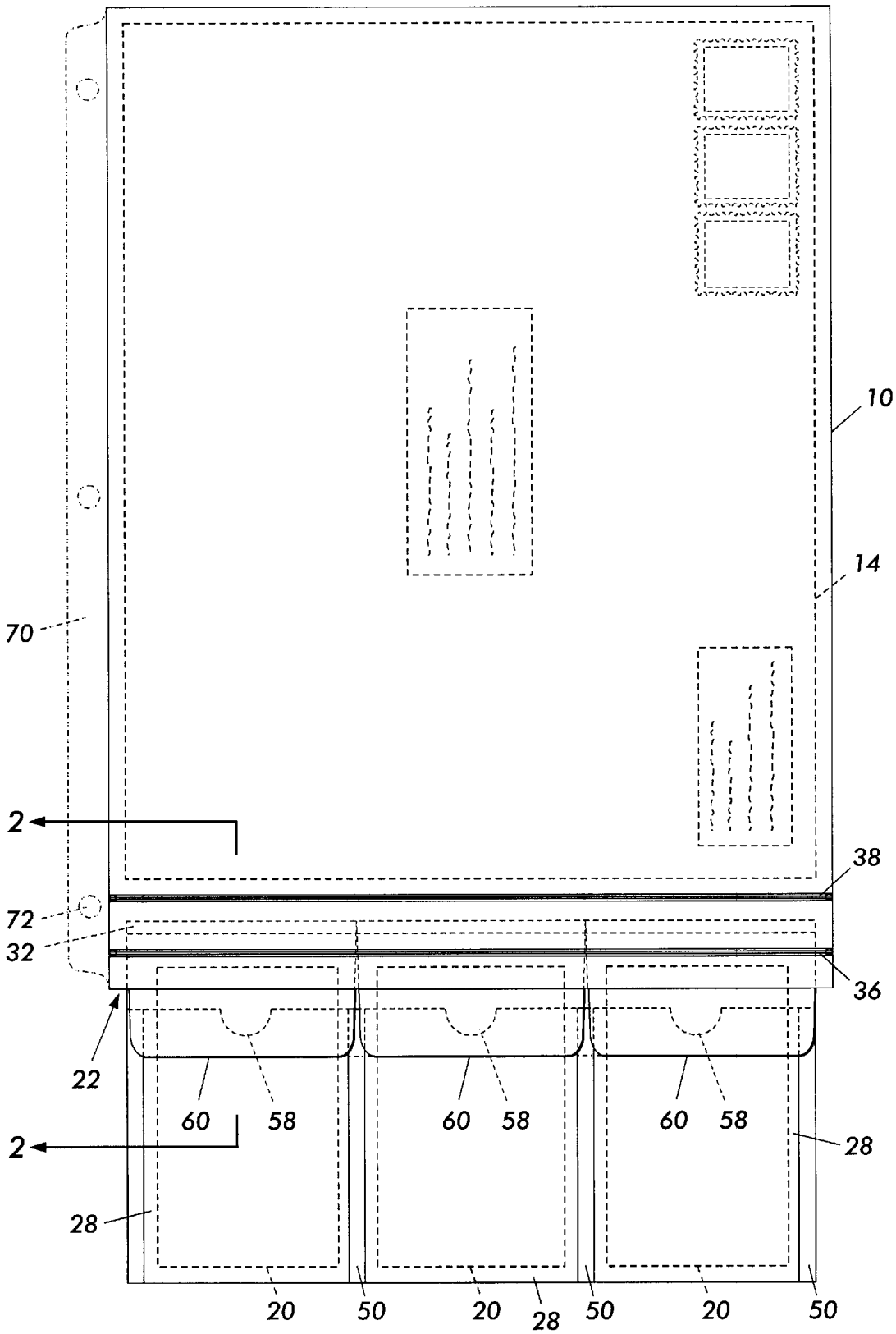
FIG. 1 is an orthogonal view of the various elements of an embodiment of the present invention.

The present invention will be described in connection with a preferred embodiment and orientation of the elements, however, it will be understood that there is no intent to limit the invention to the embodiment or orientation described. On the contrary, the intent is to cover all alternatives, modifications, and equivalents as may be included within the spirit and scope of the invention as defined by the appended claims.

DESCRIPTION OF THE PREFERRED EMBODIMENT

For a general understanding of the present invention, reference is made to the drawings. In the drawings, like reference numerals have been used throughout to designate identical elements. In describing the present invention, the following term(s) have been used in the description. "Reclosable" and "resealable" are used interchangeably herein to refer to a seal or similar mechanism in which two surfaces may be substantially closed and then re-opened without imparting significant damage to the seal or either of the surfaces.

Referring initially to FIG. 1, there is depicted an envelope 10 for holding a primary sheet or document 14 (e.g., advertisement, bill, etc.) having information displayed thereon in selective juxtaposition with a plurality of secondary sheets such as business cards 20. Envelope 10 preferably comprises a transparent rectangular or alternative-shaped sleeve for removably holding the primary sheet 14 therein and having at least one resealable edge 22 for receiving the primary sheet therethrough. It will be further appreciated that primary sheet 14 may be a duplexed document (printed on both sides) or may be a pair of simplex (single printed side) sheets placed back-to-back in order to have information showing through both the front and back of sleeve 10. Attached, preferably at a position adjacent the resealable edge 22 are at least two rectangular card pockets 28, for removably holding the plurality of secondary sheets 20.

The card pockets 28 are preferably hingedly connected to the transparent rectangular sleeve along an edge 32 thereof for movement between a juxtaposed position, preferably interior to envelope 10 wherein the pockets are flush within the envelope sleeve and overlay the secondary sheets in an orientation parallel to the primary sheet, and a distanced position outside the envelope, wherein the pockets are not flush and the secondary sheets are not overlaid on the primary sheet. While pockets 28 may be of any size suitable for fitting within the envelope 10, the pockets preferably cover one-half or less of the area of the transparent rectangular sleeve when in the juxtaposed position.

The materials used for the envelope 10 and pockets 28 may be any flexible transparent material including, for example, a bi-axially oriented polypropylene film of high clarity and archival quality, see-through, non-glare vinyl (such as used for Avery Disk & Document Holders), or an acetate. The envelope and pockets are suitable for withstanding tearing and have a thickness of between 0.001–0.010 inches, preferably having a thickness of about 0.002 inches. Furthermore, the various seams and seals along the edges may be completed using fold-sealing or permanent techniques such as heat-staking or ultrasonic welding.

Figure 2:
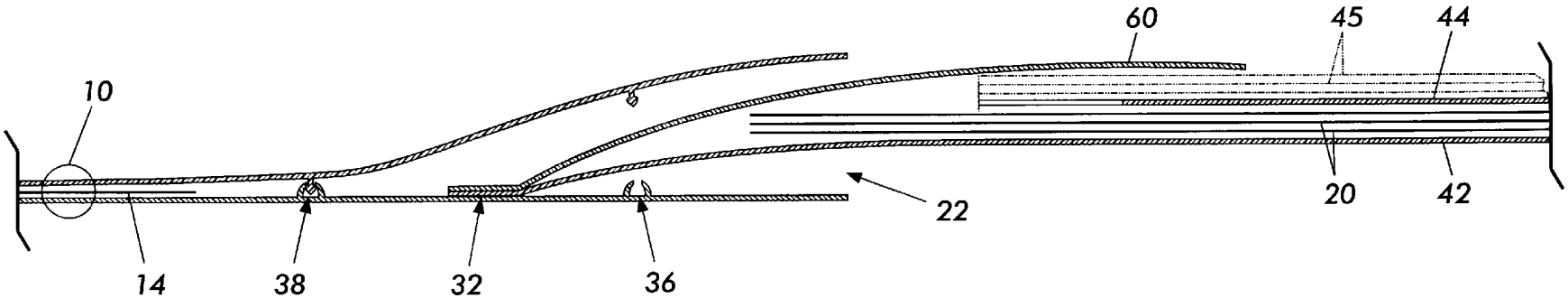
FIG. 2 is a cross-sectional view of the apparatus along line A–A' in FIG. 1.

Referring also to FIG. 2, in a region adjacent and parallel to edge 22, envelope 10 may include at least one, and possibly two, resealable closures or seals 36 and 38. The resealable closures may be constructed in a number of configurations including an adhesive border such as depicted in U.S. Pat. No. 4,640,030 issued Feb. 3, 1987 to Wood et al., and hereby incorporated by reference for its teachings. However, it is believed preferable to utilize a "Zip-Lock" type resealable closure as used for example in sandwich and freezer storage bags, and as described in the following U.S. patents, all of which are hereby incorporated by reference for their teachings:

| | | |
|---|---|---|
| US-A-3,198,228 | Aug. 3, 1965 | Naito; |
| US-A-3,473,589 | Oct. 21, 1969 | Gotz; |
| US-A-3,827,472 | Aug. 6, 1974 | Uramoto; and |
| US-A-4,846,585 | Jul. 11, 1989 | Boeckmann et al.. |

Referring again to FIGS. 1 and 2, there is illustrated the relationship between seals 36 and 38 and the pocket edge 32. From the relative locations of these elements, it will be apparent that seal 36 may be employed to retain the rectangular pockets and the plurality of secondary sheets in the juxtaposed position when seal 38 is in an open position, whereas seal 36 would be opened and seal 38 closed in order to allow the pockets 28 to be exposed and to retain sheet 14 within envelope 10. Alternatively, while depicted as a resealable closure, seal 36 may be a permanent or one-time seal and the contents of the envelope are accessed or exposed by opening or tearing the seal, or removing the end of the envelope containing seal 36.

As further depicted in FIG. 2, the rectangular pockets 28 preferably comprise a common sheet of material for a back surface 42 and at least one sheet of transparent material for the face or upper surface 44, wherein the sheet of transparent material is attached to the common sheet at locations that define the dimensions of the pockets therein. As indicated in FIG. 1, the division lines 50 that separate the pockets may be constructed using any of the previously discussed methods for attaching the upper and back surfaces.

As depicted in FIG. 2, it is further contemplated that the rectangular pockets each include pleated or otherwise expandable sides 45 (shown as dashed line expanded pockets) to allow expansion when the secondary sheets are inserted therein. Expansion may be accomplished by a pleated design such as that depicted in U.S. Pat. No. 5,513,457 to Byrnes et al., issued May 7, 1996 and hereby incorporated by reference, or via a material (e.g., elastomer) that allows for expansion. As an alternative to sheets 20, pockets 28 may also be used to store samples or other sheet goods such as wall-paper samples or the like in a wall-paper catalog book.

Referring again to FIGS. 1 and 2, it will be appreciated that an alternative or optional configuration for the present invention further includes one or more covers or overlapping flaps 60 for one or more of the rectangular pockets 28. The overlapping flaps are preferably adjacent an open end of the pockets (which is an upper end when the apparatus is hung in a display configuration with the large envelope 10 at the top). Flaps 60 serve to retain the secondary sheets 20 within the pockets and to protect the secondary sheets from rain or moisture that might strike or drip from the envelope. The flaps may be formed or constructed in accordance with the configurations depicted in U.S. Pat. No. 4,958,450 to Roberg, issued Sep. 25, 1990, or U.S. Pat. No. 5,722,694 to Baldursson, issued Mar. 3, 1998, both of which are hereby incorporated by reference for their teachings. Although depicted as a plurality of flaps 60 in FIG. 1, it will be further appreciated that a single flap covering a plurality of pockets may be used to reduce the cost or manufacturing complexity of the apparatus, and to improve the "weather-resistant" nature of pockets 28.

A further alternative or optional embodiment includes a "thumb-sized" notch or cut-out region 58 at the top edge of each of the plurality of pockets 28 to improve the ease with which an interested person can retrieve a secondary sheet or card from the pocket. The notch 58 could be present with, or without flap 60, and if flap 60 were also present, the flap would preferably extend to a point beyond the lower extent of the notch so as to assure that the contents of pocket 28 are covered.

As yet another alternative, it is possible to include an optional (and perhaps removable) tab or flap 70 along one edge of the envelope 10. Flap 70 preferably includes a plurality of holes 72 positioned along at least one edge of said transparent rectangular sleeve 10. In one embodiment, the flap 70 and holes 72 may be positioned so as to provide a means for attaching a plurality of the envelopes within a conventional ring binder or notebook as is suggested for sheet protectors in U.S. Pat. No. 6,019,539 to Lynton, issued Feb. 1, 2000, and which is hereby incorporated by reference.

In an alternative embodiment the flap 70 and a hole(s) 72 may be positioned so as to provide a means for mounting the envelope 10 to a bulletin board or similar surface with a staple, tack, tape, etc. where the mounting means would not interfere with appearance of the document within envelope 10. Moreover, mounting the envelope by the flap may avoid puncturing envelope 10 or the document therein.

Figure 3:
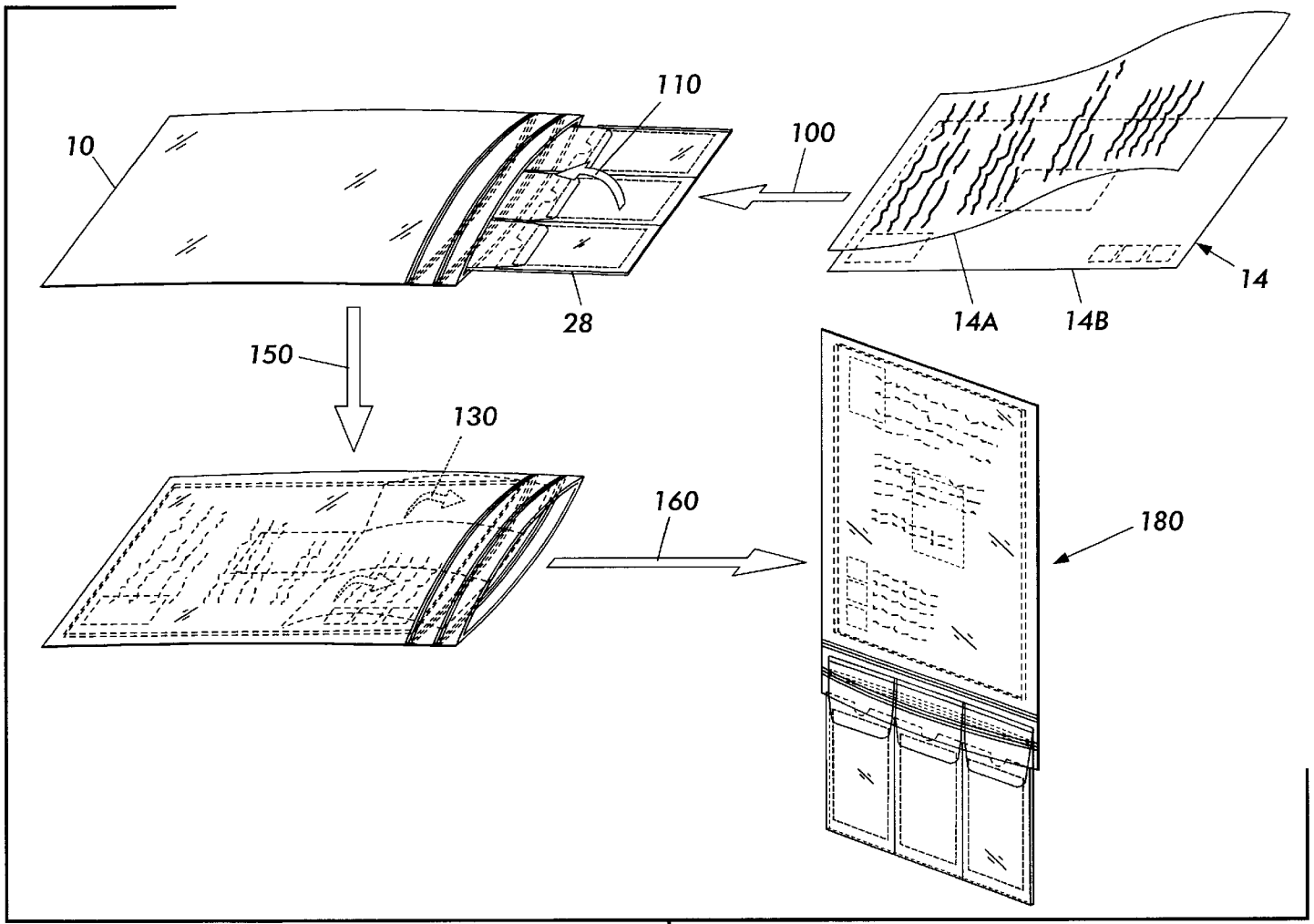
FIG. 3 is a flow diagram showing a series of perspective illustrations to depict the manner in which the present invention may be used for mailing and/or posting of advertisements.

Having described various features and aspects of the present invention, attention is now turned to FIG. 3, which, in addition to FIGS. 1 and 2, depicts the various configurations in which the present invention may be used. In addition to use as a display device, the invention is suitable for use as a mailing envelope when the pockets 28 are folded therein (top FIG. 3), and in a manner similar to that described, for example, in U.S. Pat. No. 6,023,790 to Schwartz, issued Feb. 15, 2000, hereby incorporated by reference.

In the mailing configuration, one or more sheets 14 are inserted into the envelope 10 through opened edge 22 in the direction indicated by arrow 100. Top sheet 14*a* preferably includes advertising or similar printed copy on a surface thereof and may be inserted so that the advertising copy shows through the top surface of the envelope 10. Similarly, sheet 14*b* is preferably printed to include a mailing and return address that shows through the bottom or opposite side of transparent envelope 10. It will be further appreciated that a single sheet that is printed on both sides may be employed for both the advertising copy and mailing address of sheets 14*a* and 14*b*, respectively.

Once the sheets are inserted, the pockets 28 are folded into the interior of envelope 10 in the direction indicated by arrow 110. At that time the outermost reclosable seal on envelope 10 (seal 36 in FIGS. 1 and 2) is sealed and the envelope is ready for mailing. It will be appreciated that sending of the envelope may be accomplished via the United States Postal Service, or via an alternative delivery service and that the document 14*b* may include postage or billing information as well as address information printed thereon.

Once the package is received at the designated address in step 2, indicated by arrow 150, the recipient of the envelope preferably opens the outermost seal 36 and folds the pockets out and away from the juxtaposed position in a direction indicated by arrow 130. This will expose the pockets 28 and make the business cards or other items stored in the pockets accessible to those who may wish to retrieve them. Subsequently, as depicted by arrow 160, the envelope and associated pockets may be affixed to a surface such as a wall or bulletin board 180.

In an alternative embodiment of the present invention, it is possible that the reverse or "back" side of envelope 10 may be constructed of an opaque or translucent substrate or material that is suitable for applying an address label thereto or for direct printing thereon.

In yet a further alternative embodiment, it is contemplated that the orientation of the window and pockets may be modified. Whereas the embodiments disclosed in the figures are represented as holding a bill in a "portrait" orientation, it is entirely possible, and within the scope of the present invention to modify the apparatus to hold a bill in a "landscape" orientation, where an envelope 10 for holding a primary sheet or document 14 is oriented along its long axis, having the plurality of secondary sheets and associated pockets 28 hingedly attached to envelope 10 along its long edge.

In recapitulation, the present invention is an apparatus and method for the display and shipping (mailing) of documents including a large transparent display window and a plurality of pockets associated therewith for the purpose of providing cards or samples, and to such an apparatus that may be easily folded and sealed so as to provide its own shipping envelope.

It is, therefore, apparent that there has been provided, in accordance with the present invention, an apparatus and method for the display and/or shipping of primary and associated secondary documents. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An envelope for holding a primary sheet having information displayed thereon in selective juxtaposition with a plurality of secondary sheets, comprising:

a sleeve for removably holding the primary sheet and having at least one transparent surface and at least one open edge for receiving the primary sheet therein so that at least a portion of the primary sheet is visible through the transparent surface; and at least two pockets, attached to said sleeve along a first edge thereof, for removably holding the plurality of secondary sheets therein, the pockets being hingedly connected to the sleeve along an edge thereof for movement between a juxtaposed position, wherein the pockets are flush with the sleeve and overlay the secondary sheets on the primary sheet, and a distanced position, wherein the pockets are not flush and the secondary sheets and are not overlaid on the primary sheet, wherein the pockets cover less than one-half of the surface area of the sleeve while in the juxtaposed position.

2. The envelope of claim 1, where said sleeve is of a rectangular shape.

3. The envelope of claim 1, wherein said pockets are rectangular in shape.

4. The envelope of claim 3, wherein the rectangular pockets comprise a common sheet of material for a back and at least one sheet of transparent material for the face, wherein the sheet of transparent material is attached to the common sheet at locations that define the dimensions of the pockets therein.

5. The envelope of claim 1, wherein said sleeve further comprises a seal parallel to the at least one open edge.

6. The envelope of claim 5, wherein the seal parallel to the at least one open edge is a reclosable seal.

7. The envelope of claim 6, wherein said sleeve further comprises a second reclosable seal adjacent the at least one open edge, wherein the second reclosable seal may be employed to retain the pockets and the plurality of secondary sheets in the juxtaposed position.

8. The envelope of claim 1, wherein the pockets each comprise pleated sides to allow the expansion thereof when the secondary sheets are inserted therein.

9. The envelope of claim 1, wherein the pockets each further comprise an overlapping flap adjacent an open end thereof, said flap serving to retain the secondary sheets within the pockets and to protect the secondary sheets.

10. The envelope of claim 1, further comprising a flap, having at least one hole, positioned along an edge of said sleeve.

11. A mailing device, comprising:

a substantially rectangular panel of opaque material, one face of the opaque material having a space for a recipient address;

an envelope, formed by at least one transparent rectangular sheet affixed to the opposing face of the opaque material, for removably holding a primary sheet having information displayed thereon in selective juxtaposition with a plurality of secondary sheets and having at least one open edge for receiving the primary sheet therethrough; and a plurality of rectangular pockets, attached to said envelope along an edge thereof, for removably holding the plurality of secondary sheets therein, the at least two pockets being hingedly connected to the envelope along an edge thereof for movement between a juxtaposed position, wherein the pockets are flush within the sleeve and overlay the secondary sheets on the primary sheet, and a distanced position, wherein the pockets are not flush and the secondary sheets are not overlaid on the primary sheet.

12. The mailing device of claim 11, wherein the open edge and the edge to which the plurality of pockets are hingedly connected are the same edge.

13. The mailing device of claim 12, wherein the plurality of rectangular pockets may be folded within the envelope, and where the device further comprises a seal parallel to the at least one open edge.

14. The mailing device of claim 11, wherein the envelope further includes a pair of seals, where the plurality of pockets and secondary sheets are held within the envelop in the juxtaposed position when the second seal is closed, and are allowed to move to the distanced position when said tearable seal is opened and the first seal is closed.

15. The mailing device of claim 14, wherein the first seal is a re-closable seal.

16. The mailing device of claim 15, wherein the second seal is a one-time seal.

17. The mailing device of claim 11, wherein the plurality of pockets each comprise pleated sides to allow the expansion thereof.

18. The mailing device of claim 11, wherein the plurality of pockets are covered by at least one overlapping flap adjacent open ends of the pockets, said flap serving to retain the secondary sheets within the pockets and to protect the secondary sheets.

19. A method for shipping and displaying a primary sheet and a plurality of econdary sheets associated with the primary sheet, including the steps of:

inserting the primary sheet, the sheet having information displayed thereon, in n envelope, at least a portion of which is transparent, so as to allow the information on the primary sheet to be viewed through the envelope, wherein the primary sheet is inserted through an open edge of the envelope for receiving the primary sheet therein;

inserting into one of a plurality of pockets attached to said transparent envelope along a first edge thereof, a plurality of secondary sheets;

folding, at a position parallel to the first edge, the plurality of pockets attached to said transparent envelope into the interior of the transparent envelope to hold the primary sheet in selective juxtaposition therewith;

sealing a seal along said first edge to retain the pockets and secondary sheets therein in juxtaposition with the primary sheet;

shipping the sealed envelope;

opening the envelope upon receipt by breaking the seal along the first edge so as to allow removal of the pockets and secondary sheets therein;

removing the pockets and secondary sheets therein; and unfolding the plurality of pockets attached to said transparent envelope so as to reveal the primary sheet retained in the transparent envelop and the secondary sheets retained in the pockets.

20. The method of claim 19, further including the step of:

sealing a second seal parallel to said first edge and internal to the first seal to retain the primary sheet within the envelope.

* * * * *